US010847311B2

(12) United States Patent
Cho

(10) Patent No.: US 10,847,311 B2
(45) Date of Patent: Nov. 24, 2020

(54) ANTENNA DEVICE FOR NEAR FIELD WIRELESS COMMUNICATION AND PORTABLE TERMINAL HAVING THE SAME

(71) Applicant: Samsung Electronics Co., Ltd., Suwon-si (KR)

(72) Inventor: Kyusik Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 109 days.

(21) Appl. No.: 16/135,616

(22) Filed: Sep. 19, 2018

(65) Prior Publication Data

US 2019/0019621 A1 Jan. 17, 2019

Related U.S. Application Data

(63) Continuation of application No. 13/847,693, filed on Mar. 20, 2013, now abandoned.

(30) Foreign Application Priority Data

Mar. 21, 2012 (KR) ..... 10-2012-0028769

(51) Int. Cl.
*H01Q 7/00* (2006.01)
*H01F 38/14* (2006.01)
(Continued)

(52) U.S. Cl.
CPC ..... *H01F 38/14* (2013.01); *H01Q 1/1271* (2013.01); *H01Q 1/2208* (2013.01); *H01Q 1/243* (2013.01); *H01Q 1/38* (2013.01); *H01Q 7/00* (2013.01)

(58) Field of Classification Search
CPC .... H01F 38/14; H01Q 1/1271; H01Q 1/2208; H01Q 1/243; H01Q 1/38; H01Q 7/00
See application file for complete search history.

(56) References Cited

U.S. PATENT DOCUMENTS 7,119,693 B1 * 10/2006 Devilbiss ..... G06K 7/0008 340/572.5
7,388,547 B2 6/2008 Lee
(Continued)

FOREIGN PATENT DOCUMENTS

CN 1234190 C 12/2005
CN 1905272 A 1/2007
(Continued)

OTHER PUBLICATIONS

Haselesteiner et al., "Security in Near Field Communication (NFC): Strengths and Weaknesses", Philips Semiconductors, Jun. 29, 2007.

*Primary Examiner* — Daniel Munoz
*Assistant Examiner* — Bamidele A Jegede
(74) *Attorney, Agent, or Firm* — Jefferson IP Law, LLP

(57) ABSTRACT

An antenna device for near field wireless communication which may be mounted at a part of a Black Mark (BM) region of a window, and a portable terminal having the same are provided. The antenna device for near field wireless communication mounted in the portable terminal having a BM region, includes: a plurality of flexible printed circuit board layers stacked at a partial region of a lower portion of the BM region, a plurality of conductive antenna patterns of a loop type provided for the plurality of flexible printed circuit board layers, respectively, and a plurality of through holes through which adjacent conductive antenna patterns are connected to each other among the plurality of conductive antenna patterns of a loop type such that the plurality of conductive antenna patterns are electrically connected to each other so as to define one loop antenna.

17 Claims, 6 Drawing Sheets

(51) Int. Cl.

| | |
|---|---|
| ***H01Q 1/12*** | (2006.01) |
| ***H01Q 1/22*** | (2006.01) |
| ***H01Q 1/24*** | (2006.01) |
| ***H01Q 1/38*** | (2006.01) |

(56) References Cited

U.S. PATENT DOCUMENTS

| | | | | |
|---|---|---|---|---|
| 7,830,311 | B2 | 11/2010 | Kataya et al. | |
| 8,654,030 | B1 | 2/2014 | Mercer | |
| 2002/0105470 | A1* | 8/2002 | Kim | G06K 7/10336 343/741 |
| 2002/0135523 | A1* | 9/2002 | Romero | G06F 1/1616 343/741 |
| 2006/0061512 | A1* | 3/2006 | Asano | G06F 1/1616 343/702 |
| 2007/0024509 | A1 | 2/2007 | Lee | |
| 2007/0063041 | A1 | 3/2007 | Kamiyama et al. | |
| 2008/0169349 | A1* | 7/2008 | Suzuki | H01L 21/84 235/492 |
| 2008/0252530 | A1 | 10/2008 | Bae et al. | |
| 2009/0051620 | A1* | 2/2009 | Ishibashi | H01Q 1/243 343/897 |
| 2009/0065594 | A1 | 3/2009 | Kato et al. | |
| 2009/0109102 | A1 | 4/2009 | Dokai et al. | |
| 2009/0179806 | A1 | 7/2009 | Ji et al. | |
| 2009/0197654 | A1* | 8/2009 | Teshima | H01Q 1/243 455/575.7 |
| 2009/0247243 | A1 | 10/2009 | Chen et al. | |
| 2010/0090824 | A1 | 4/2010 | Rowell et al. | |
| 2010/0093410 | A1* | 4/2010 | Cho | G06F 1/1624 455/575.4 |
| 2010/0156735 | A1 | 6/2010 | Nakamura et al. | |
| 2010/0321255 | A1* | 12/2010 | Kough | H01Q 1/2266 343/702 |
| 2010/0321325 | A1* | 12/2010 | Springer | H01Q 9/16 345/174 |
| 2011/0024510 | A1* | 2/2011 | Kato | G06K 19/07779 235/492 |
| 2011/0031320 | A1 | 2/2011 | Kato et al. | |
| 2011/0127337 | A1 | 6/2011 | Ikemoto et al. | |
| 2011/0164047 | A1 | 7/2011 | Pance | |
| 2011/0279340 | A1 | 11/2011 | Kato et al. | |
| 2012/0326931 | A1 | 12/2012 | Murayama et al. | |
| 2013/0078917 | A1* | 3/2013 | Cho | H01Q 7/00 455/41.1 |
| 2013/0207854 | A1* | 8/2013 | Ryu | H01Q 21/28 343/702 |

FOREIGN PATENT DOCUMENTS

| | | | | |
|---|---|---|---|---|
| CN | 201215827 | Y | 4/2009 | |
| CN | 201515004 | U | 6/2010 | |
| EP | 1564839 | A2 | 8/2005 | |
| EP | 2023275 | A1 | 2/2009 | |
| EP | 2056400 | A1 | 5/2009 | |
| JP | 2002-353725 | A | 12/2002 | |
| KR | 20110077362 | * | 10/2009 | H01Q 1/24 |
| KR | 10-2010-0052927 | A | 5/2010 | |
| KR | 10-2010-0062539 | A | 6/2010 | |
| KR | 10-2011-0077594 | A | 7/2011 | |
| KR | 10-2013-0034187 | A | 4/2013 | |
| WO | 2011-108340 | A1 | 9/2011 | |

* cited by examiner

ANTENNA DEVICE FOR NEAR FIELD WIRELESS COMMUNICATION AND PORTABLE TERMINAL HAVING THE SAME

PRIORITY

This application is a continuation application of prior application Ser. No. 13/847,693, filed on Mar. 20, 2013, which claimed priority under 35 U.S.C. § 119(a) of a Korean patent application number 10-2012-0028769, filed on Mar. 21, 2012, in the Korean Intellectual Property Office, the disclosure of which is incorporated by reference herein in its entirety.

BACKGROUND OF THE INVENTION

1. Field of the Invention

The present invention relates to an antenna device for near field wireless communication and a portable terminal having the same. More particularly, the present invention relates to an antenna device for near field wireless communication which may be mounted at a part of a Black Mark (BM) region of a window, and a portable terminal having the same.

2. Description of the Related Art

In recent years, portable terminals have increasingly been used for data sharing, for payment and settlement, and for ticketing. Accordingly, a need and use for a terminal mounting an antenna device for near field wireless communication has similarly increased. In general, the antenna device for near field wireless communication includes an inductor-capacitor (LC) resonance loop antenna using magnetic coupling to perform near field communication within a distance of approximately 10 to 20 cm using a low frequency communication of approximately 13.56 MHz (+7 kHz).

FIG. 1 is a schematic view illustrating an antenna device for near field wireless communication according to the related art.

Referring to FIG. 1, the antenna device 10 for near field wireless communication according to the related art includes a plurality of conductive lines of a loop type prepared as a single layer. The antenna device 10 for near field wireless communication according to the related art has a total area of 1500 $mm^2$ or greater and a short axis length L of 30 mm or longer in order to obtain sufficient electromotive force. For example, the antenna device 10 for near field wireless communication according to the related art requires a relatively wide mounting space. The design and manufacture of antenna devices for near field wireless communication according to the related art are subject to various constraints and limitations associated with reducing a width S of an antenna pattern because a plurality of conductive lines are disposed as a single layer in the antenna device 10 for near field wireless communication according to the related art. The width S of the antenna pattern is obtained by adding a sum of widths S1 of the conductive lines to a sum of widths S2 (e.g., corresponding to intervals between the conductive lines) of parts in which the conductive lines are not formed. For example, if a width of one conductive line is 0.8 mm, an interval between conductive lines is 0.4 mm, and the number of loops formed by the plurality of antenna lines is 4, the width S of the antenna pattern is 4.8 mm ((0.8 mm+0.4 mm)×4).

However, recent designs of portable terminals require a greater number of electronic parts to be mounted thereon in order to reduce the thickness of the portable terminal. For example, recent portable terminal may mount many electronic parts to provide various functions and to reduce the thickness. Because of such developments to portable terminals, the portable terminal according to the related art has a difficulty in ensuring that sufficient area remains for a mount region for the antenna device 10 for near field wireless communication. Because of the lack of mounting space on the portable terminal according to the related art, recent designs include a scheme of mounting an antenna for near field wireless communication in a battery or a battery cover of a terminal. However, such a scheme has a disadvantage relating to performance of the antenna device for near field wireless communication. For example, performance of the antenna device for near field wireless communication is low to the extent that a user cannot use the antenna device when the battery cover is made of metal.

Therefore, a need exists for an apparatus, system, and method for providing an antenna device for near field wireless communication mounted at a part of a BM region of a window without requiring a separate mount space.

The above information is presented as background information only to assist with an understanding of the present disclosure. No determination has been made, and no assertion is made, as to whether any of the above might be applicable as prior art with regard to the present invention.

SUMMARY OF THE INVENTION

Aspects of the present invention are to address at least the above-mentioned problems and/or disadvantages and to provide at least the advantages described below. Accordingly, an aspect of the present invention is to provide an antenna device for near field wireless communication mounted at a part of a Black Mark (BM) region of a window without requiring a separate mount space, and a portable terminal having the same.

In accordance with an aspect of the present invention, an antenna device for near field wireless communication mounted in a portable terminal having a BM region is provided. The antenna device includes a plurality of flexible printed circuit board layers stacked at a partial region of a lower portion of the BM region, a plurality of conductive antenna patterns of a loop type provided for the plurality of flexible printed circuit board layers, respectively, and a plurality of through holes through which adjacent conductive antenna patterns of the plurality of conductive antenna patterns are connected to each other such that the plurality of conductive antenna patterns are electrically connected to each other so as to define one loop antenna.

In accordance with another aspect of the present invention, a portable terminal having an antenna device for near field communication is provided. The portable terminal includes a window provided on a front surface of the portable terminal, and including a transparent region transmitting an image and a BM region provided around the transparent region, and an antenna device for near field wireless communication comprising a stack of a plurality of flexible printed circuit boards, including a conductive antenna pattern of a loop type provided for each flexible printed circuit board layer, the conductive antenna patterns being electrically connected to each other so as to define one loop antenna, wherein the antenna device is provided at a partial region of a lower portion of the BM region.

In accordance with other aspect of the present invention, an antenna device for near field wireless communication for mounting in a portable terminal is provided. The antenna device includes a plurality of stacked circuit layers, wherein each circuit layer comprises one or more conductive antenna patterns forming at least a partial loop, and one or more connectors for electrically connecting conductive antenna patterns of different layers such that the conductive antenna patterns and connectors define one or more loop antennas, wherein the conductive antenna patterns have a same size and shape.

In accordance with other aspect of the present invention, an antenna device for near field wireless communication for mounting in a portable terminal is provided. The antenna device includes a plurality of stacked circuit layers, wherein each circuit layer comprises one or more conductive antenna patterns forming at least a partial loop, and one or more connectors for electrically connecting conductive antenna patterns of different layers such that the conductive antenna patterns and connectors define one or more loop antennas, wherein the conductive antenna patterns have different sizes and are alternately arranged in each layer.

In accordance with other aspect of the present invention, an antenna device for near field wireless communication for mounting in a portable terminal is provided. The antenna device includes a plurality of stacked circuit layers, wherein each circuit layer comprises one or more conductive antenna patterns forming at least a partial loop, one or more connectors for electrically connecting conductive antenna patterns of different layers such that the conductive antenna patterns and connectors define one or more loop antennas, and one or more dummy layers, wherein the one or more dummy layers are arranged between the plurality of stacked circuit layers.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features and advantages of certain exemplary embodiments of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, detailed descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 2:
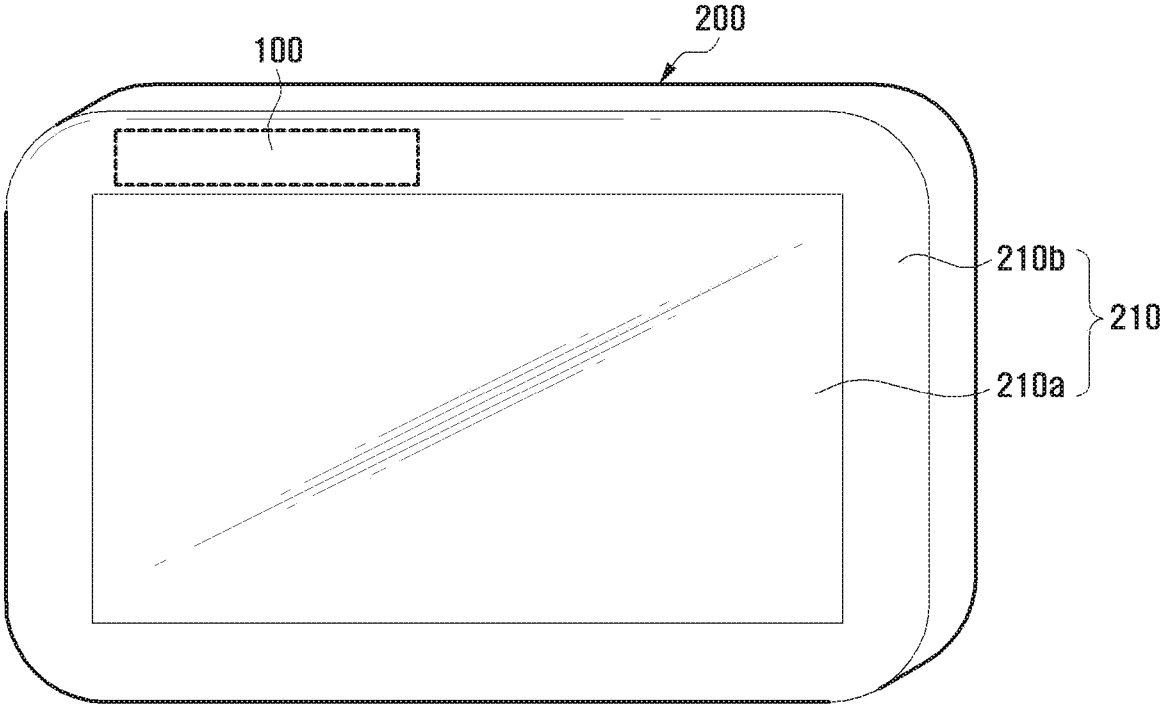
FIG. 2 is a view illustrating a portable terminal having an antenna device for near field wireless communication according to an exemplary embodiment of the present invention.
Figure 3:
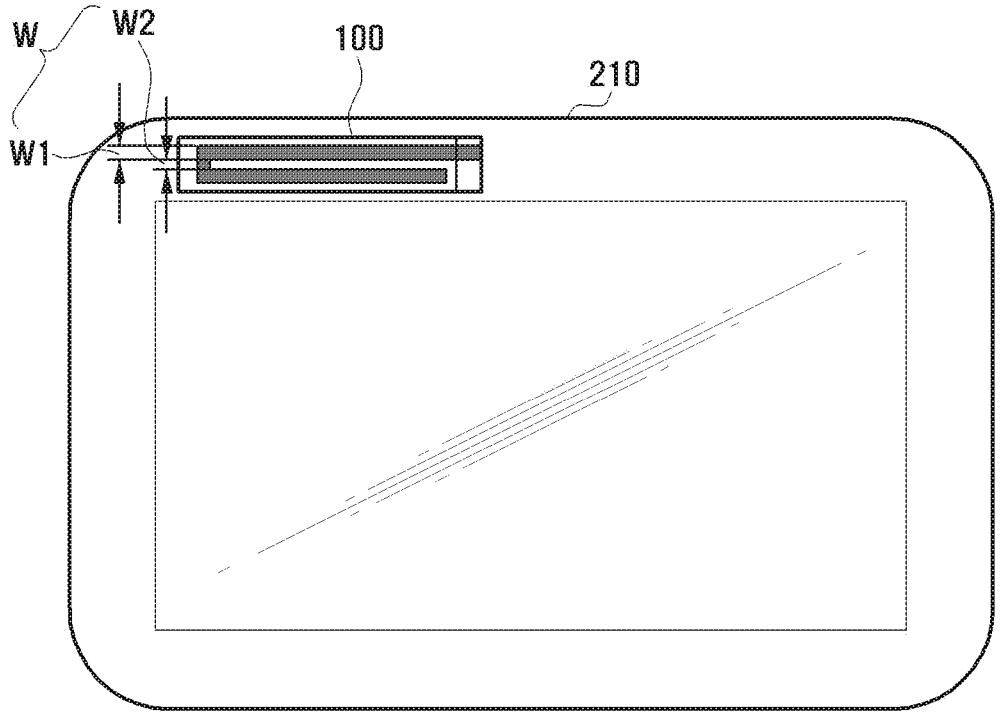
FIG. 3 is a rear view illustrating a window of a portable terminal having an antenna device for near field wireless communication such as, for example, the portable terminal shown in FIG. 2 according to an exemplary embodiment of the present invention.
Figure 4:
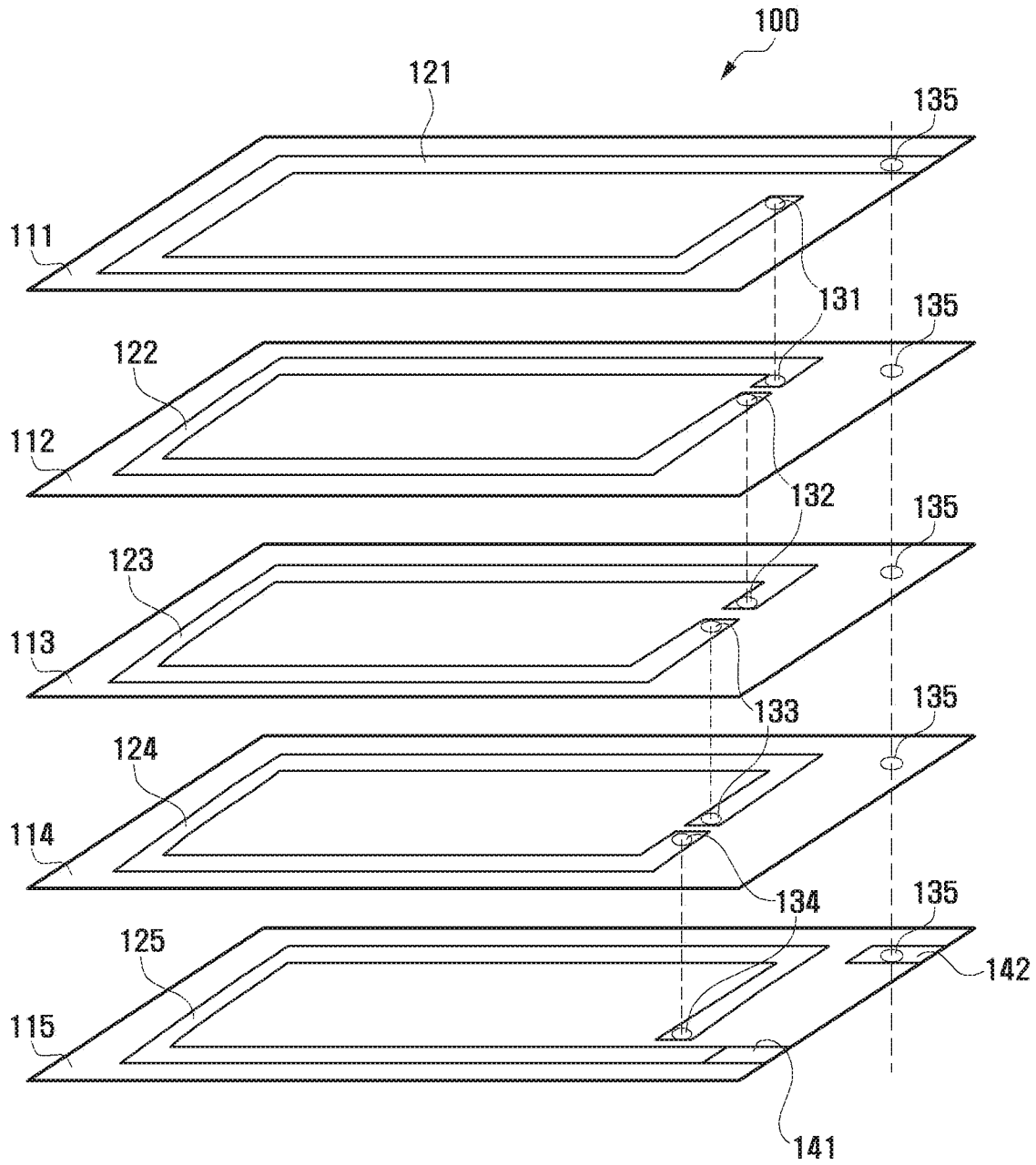
FIG. 4 is a view illustrating an antenna device for near field wireless communication according to an exemplary embodiment of the present invention.

FIG. 2 is a view illustrating a portable terminal having an antenna device for near field wireless communication according to an exemplary embodiment of the present invention. FIG. 3 is a rear view illustrating a window of a portable terminal having an antenna device for near field wireless communication such as, for example, the portable terminal shown in FIG. 2. FIG. 4 is a view illustrating an antenna device for near field wireless communication according to an exemplary embodiment of the present invention.

Referring to FIGS. 2 to 4, the portable terminal 200 may be a bar-type terminal which has a rectangular shape, and has a front surface on which a window 210 is mounted. The portable terminal 200 may include a mobile communication terminal, a Portable Multimedia Player (PMP), a Tablet Personnel Computer (PC), an E-book terminal, and the like.

The window 210 may be made of a transparent material such as glass or a transparent acryl, and may be provided as a constituent element for protecting a display device (not shown) displaying an image.

The window 210 is disposed at a front surface of an upper portion of a display device (not shown). The display device (not shown) may be configured to include a Liquid Crystal Display (LCD), an Organic Light Emitting Diode (OLED), and/or the like. The display device (not shown) may be provided in the form of a touch screen including a touch panel (not shown) for detecting touch input.

As shown in FIGS. 2 and 3, the window 210 may be divided into a transparent region 210*a* transmitting an image and a Black Mark (BM) region 210*b* formed around the transparent region 210*a*. The BM region 210*b* formed around the transparent region 210*a* may be a region that does not transmit an image, and may be provided, for example, in the form of an opaque region for performing a light insulating or light blocking function. The BM region 210*b* prevents an inside of the portable terminal 200 from being viewed by the user, and prevents light from being leaked. The BM region 210*b* may be formed by adhering a black tape (not shown) adhering to a rear surface of the window 210 or printing, coating, or evaporating a dark paint on the rear surface of the window 210. Although a color is not expressed in FIGS. 2 and 3, the BM region 210*b* is generally dark. However, the BM region 210*b* may have a different color (e.g., white) according to a color of the portable terminal 200.

The antenna device 100 for near field wireless communication may be an antenna for supporting a near field wireless communication function. For example, the antenna device 100 may be a Near Field Communication (NFC) antenna for supporting an NFC function. Hereinafter, for convenience of a description, the NFC antenna refers to an antenna device. According to an exemplary embodiment of the present invention, the antenna device 100 may be mounted at a partial region of a bottom end of the BM region 210*b* of the window 210 located at a front surface of the portable terminal 200. To this end, the antenna device 100 is formed by stacking a plurality of layers, for example in the form of Flexible Printed Circuit Boards (FPCBs). Each layer may include one or more conductive antenna patterns forming at least one partial loop. For example, the conductive antenna portion formed on a layer may form one or more partial loops and/or one or more full loops (e.g. open loops or closed loops). A full loop may be, for example, a pattern that encloses an area, and a partial loop may be a pattern that forms a part of a full loop. For example, each FPCB layer may include one conductive line of a loop type. As described above, the antenna device 100 may be implemented using a plurality of FPCB layers so that exemplary embodiments of the present invention may significantly reduce a width W of an antenna pattern.

Figure 1:
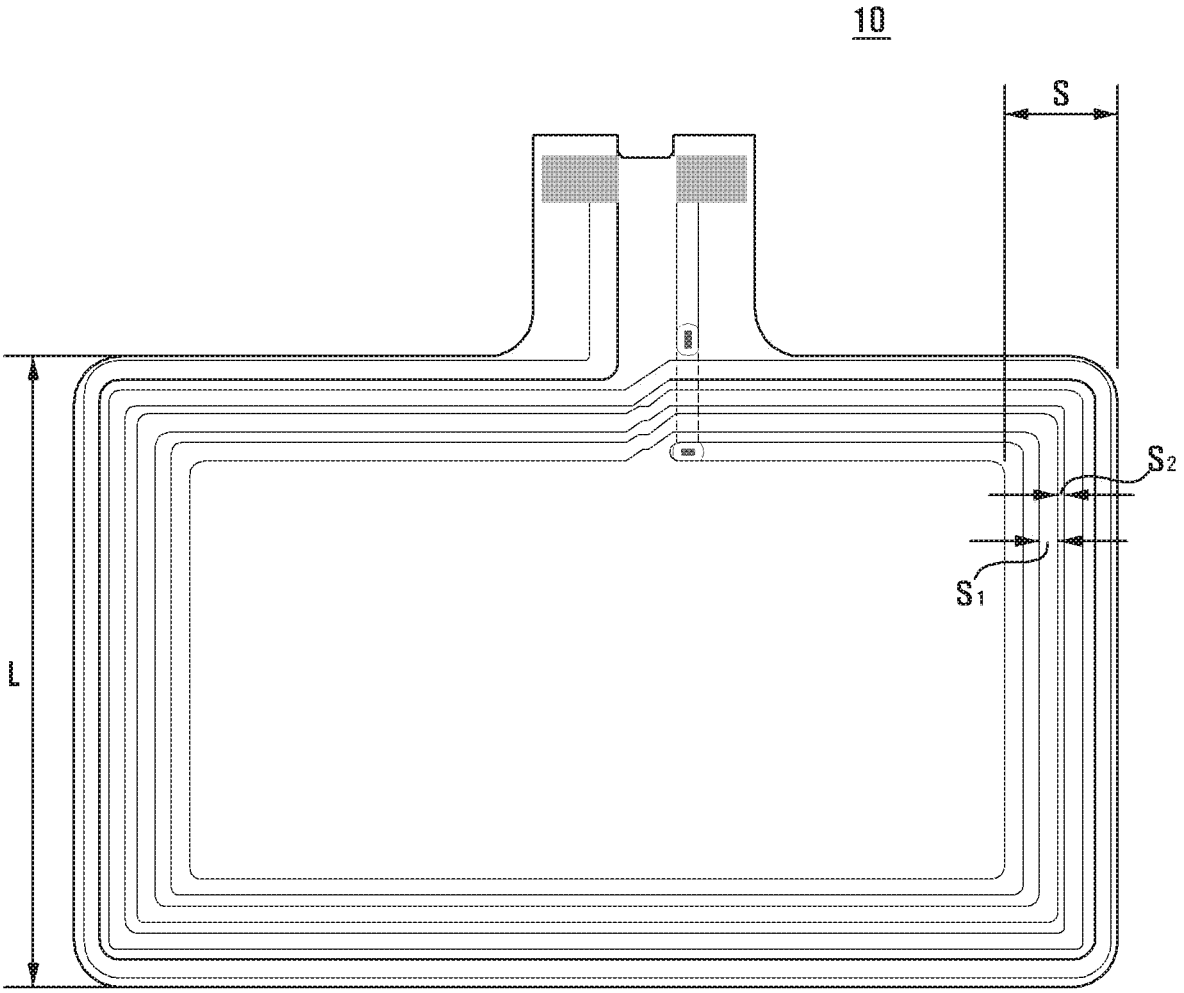
FIG. 1 (RELATED ART)
FIG. 1 is a schematic view illustrating an antenna device for near field wireless communication according to the related art.

With respect to reduction of a width of the antenna pattern, referring to FIG. 3, if a width W1 of each of conductive lines 121, 122, 123, 124, and 125 is 0.8 mm and a width W2 between conductive lines is 0.2 mm, the width W of the antenna pattern of the antenna device 100 is 1 mm (0.8 mm+0.2 mm). It may be understood that a width W of an antenna pattern of the antenna device 100 is significantly reduced as compared with an antenna device 10 according to the related art shown in FIG. 1 having a width of an antenna pattern of "4.8 mm". As described above, according to exemplary embodiments of the present invention, a width of the antenna pattern is significantly reduced such that the antenna device 100 may be mounted at a BM region 210*b* of the window 210. Accordingly, exemplary embodiments of the present invention do not require a separate mounting space of the antenna device. That is, exemplary embodiments of the present invention require a small mounting space of the antenna device.

A structure of the antenna device 100 will be described in detail with reference to FIG. 4. The antenna device 100 according to the exemplary embodiment of the present invention is implemented in such a manner that a plurality of FPCB layers, for example, five FPCB layers 111, 112, 113, 114, and 115 are laminated. The FPCB layers may be of any suitable shape, for example a rectangular shape. The length of a shorter axis of the FPCB layers may be smaller than a width of the BM region. In the embodiment illustrated in FIG. 4, each FPCB layer includes a conductive line constituting one loop. In this case, the loop includes an open loop. For example, a first FPCB layer 111 may include a first conductive line 121, a second FPCB layer 112 may include a second conductive line 122, a third FPCB layer 113 may include a third conductive line 123, a fourth FPCB layer 114 may include a fourth conductive line 124, and a fifth FPCB layer 115 may include a fifth conductive line 125. In other embodiments, one or more of the layers may include more than one loop.

The first conductive line 121 to the fifth conductive line 125 may be connected to each other and operate as one loop antenna. For example, the first conductive line 121 to the fifth conductive line 125 may be an antenna pattern for constituting one loop antenna. To this end, one end of the first conductive layer 121 may be connected to one end of the second conductive line 122 through a first electrical connector (e.g. through hole 131), the other end of the second conductive layer 122 may be connected to one end of the third conductive layer 123 through a second electrical connector (e.g. through hole 132), the other end of the third conductive line 123 may be connected to one end of the fourth conductive line 124 through a third electrical connector (e.g. through hole 133), and the other end of the fourth conductive layer 124 may be connected to one end of a fifth conductive liner 125 through a fourth electrical connector (e.g. through hole 134). The other end of the fifth conductive line 125 is connected to a first terminal (e.g. connector 141). The other end of the first conductive line 121 is connected to a second terminal (e.g. connector 142) through a fifth electrical connector (e.g. through hole 135). The first terminal (e.g. connector 141) and the second terminal (e.g. connector 142) are connected to a communication module (e.g., near field wireless communication module) mounted in a printed circuit board. In this case, one of the connector 141 and the second connector 142 may perform a function of a power supply unit of a loop antenna and the other may perform a function of a ground unit. Inner sides of the first through hole 131 to the fifth through hole 135 may be filled with a conductive material. The conductive lines of respective FPCB layers may be electrically connected to each other due to the conductive material. However, according to exemplary embodiments of the present invention is not limited such that respective one sides of the conductive lines 121 to 125 are connected to each other through a through hole filled with a conductive material. For example, the conductive lines may be electrically connected by various schemes such as soldering, and the like.

In other embodiments, a plurality of conductive lines of various layers may be divided into two or more groups and the conductive lines in each group may be connected so as to operate as two or more loop antennas.

The conductive lines may be formed in any suitable shape, for example circular, square, rectangular, or other suitable regular or irregular shape, and may be formed in any suitable size. The conductive lines of different layers may be formed of the same size and/or shape, or may be formed of different sizes and/or shapes.

In FIG. 4, conductive lines 121, 122, 123, 124, and 125 formed at the FPCB layers 111, 112, 113, 114, and 115 are overlapped with each other when viewed from the top. However, exemplary embodiments of the present invention are not limited thereto. In some embodiments, some or all of the conductive lines may be arranged to fully overlap when viewed from the top, some or all of the conductive lines may be arranged to partially overlap when viewed from the top, and/or some of the conductive lines may be arranged to not overlap when viewed from the top. Various exemplary arrangements of the conductive lines will be described below with reference to FIG. 5.

Because the antenna device 100 according to exemplary embodiments of the present invention as mentioned above is provided on only a portion of the window 210 (e.g. at a partial region of a bottom end of the BM region 210*b* of the window 210) using multiple layers (e.g. a multi FPCB layer), the portable terminal 200 does not need to provide a separate mounting region for mounting the antenna device 100. Because the antenna device 100 is formed by laminating a plurality of conductive lines 121, 122, 123, 124, and 125, exemplary embodiments of the present invention can reduce a size (e.g. width) of an antenna pattern in comparison with an antenna device of the related art forming a plurality of loops with a single layer.

Because the antenna device 100 according to the exemplary embodiment of the present invention is formed using a multi-FPCB layer, the antenna device 100 may be mounted at the BM region 210*b* of the window 210 located at a front part of the portable terminal 200. Accordingly, the antenna device 100 may radiate or receive a wireless signal to or from a forward direction of the portable terminal 200. Accordingly, even if a battery cover (not shown) located at a rear surface of the portable terminal 200 is made of metal, exemplary embodiments of the present invention may prevent the performance of the antenna device 100 from being lowered.

Figure 5A:
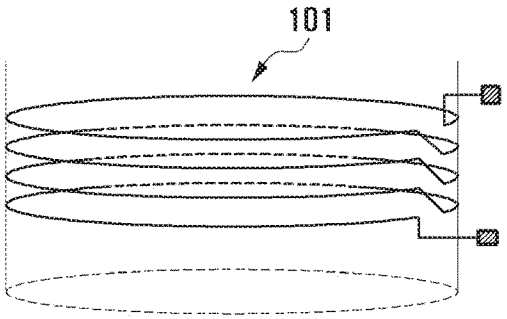
FIGS. 5A to 5I are a diagrams illustrating antenna devices for near field wireless communication according to various exemplary embodiments of the present invention.
Figure 5B:
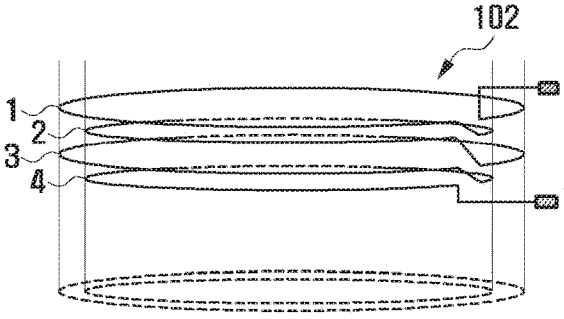
Figure 5C:
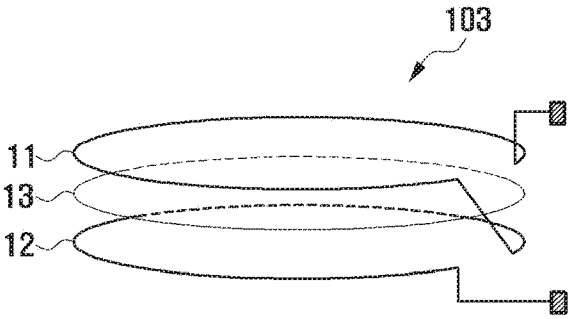
Figure 5D:
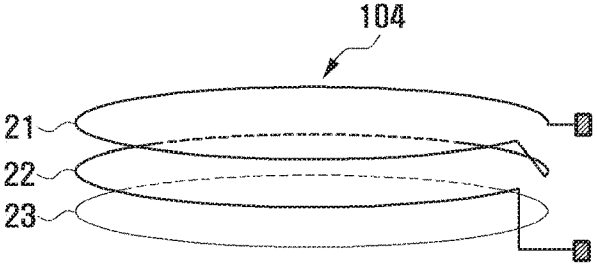
Figure 5E:
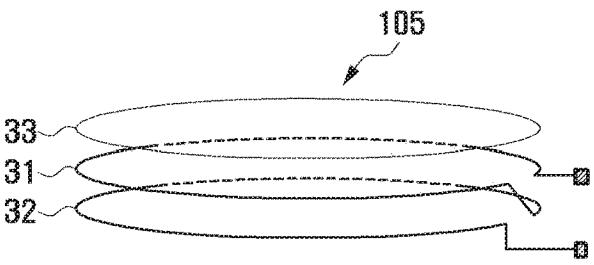
Figure 5F:
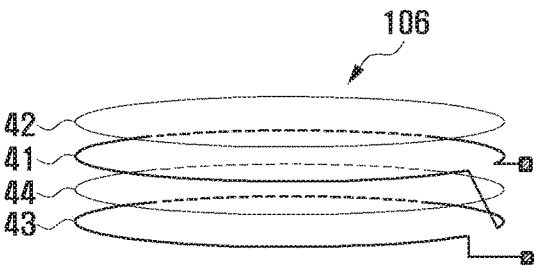
Figure 5G:
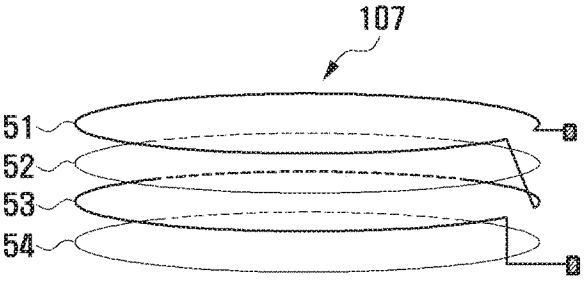
Figure 5H:
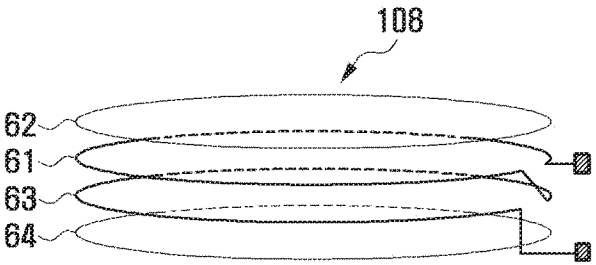
Figure 5I:
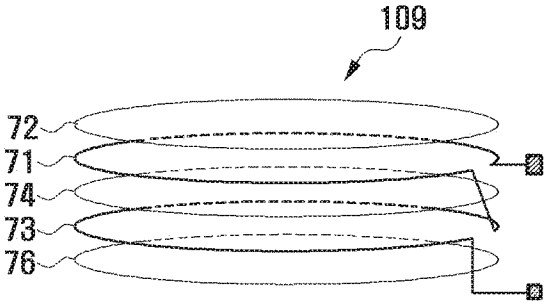

FIGS. 5A to 5I are diagrams illustrating antenna devices for near field wireless communication according to various exemplary embodiments of the present invention. More specifically, FIG. 5A illustrates an antenna device 101 according to a first exemplary embodiment of the present invention; FIG. 5B illustrates an antenna device 102 according to a second exemplary embodiment of the present invention; FIG. 5C illustrates an antenna device 103 according to a third exemplary embodiment of the present invention; FIG. 5D illustrates an antenna device 104 according to a fourth exemplary embodiment of the present invention; FIG. 5E illustrates an antenna device 105 according to a fifth exemplary embodiment of the present invention; FIG. 5F illustrates an antenna device 106 according to a sixth exemplary embodiment of the present invention; FIG. 5G illustrates an antenna device 107 according to a seventh exemplary embodiment of the present invention; FIG. 5H illustrates an antenna device 108 according to an eighth exemplary embodiment of the present invention; and FIG. 5I illustrates an antenna device 109 according to ninth exemplary embodiment of the present invention.

Referring to FIGS. 5A to 5I, in the antenna device 100 according the present invention, conductive lines constituting a loop antenna can be laminated in various forms. Antenna devices according to respective exemplary embodiments will be described by changing a final number of an identification of the antenna device 100 below. That is, the antenna devices illustrated in FIGS. 5A to 5I are denoted by reference numerals 101 to 109, respectively.

The antenna device 101 according to a first exemplary embodiment of the present invention shown in FIG. 5A is characterized such that conductive lines located at each FPCB layer have the same form (e.g., size and shape). For example, conductive lines in the antenna device 101 according to the first exemplary embodiment overlap with each other so that the antenna device 101 appears to include one conductive line when viewed from the top. As illustrated in FIG. 3, a width of an antenna pattern of the antenna device 101 according to the first exemplary embodiment is 1 mm.

FIG. 5B illustrates an antenna device 102 according to a second exemplary embodiment. As shown in FIG. 5B, at least two conductive lines having different sizes may alternately arranged. For example, a first conductive line 1 and a third conductive line 3 may have a first form, whereas a second conductive line 2 and a fourth conductive line 4 may have a second form. In this case, the first conductive line 1 and the third conductive line 3 may have a size larger than that of the second conductive layer 2 and the fourth conductive line 4. Conversely, the first conductive line 1 and the third conductive line 3 may have a size smaller than that of the second conductive layer 2 and the fourth conductive line 4. As compared with the antenna device 101 according to the first exemplary embodiment, interference between conductive lines formed at an adjacent layer is small so that the performance of the antenna device 102 according to the second exemplary embodiment of the present invention can be relatively improved.

Because a plurality of conductive lines are laminated at a plurality of FPCB layers in the antenna device 102 according to the second exemplary embodiment of the present invention shown in FIG. 5B in the same manner as in the antenna device 101 according to the first exemplary embodiment of the present invention, the width of the antenna pattern may be reduced as compared with the antenna device according to the related art.

The first conductive line 1 and the second conductive line 2 may partially overlap each other or be spaced apart from each other without overlapping when the antenna device 102 is viewed from the top.

For example, when each width of the first conductive line 1 and the second conductive line 2 is 0.8 mm, and a spacing distance between the first conductive line 1 and the second conductive line 2 is 0.2 mm, then a width of the antenna pattern of the antenna device 102 according to the second exemplary embodiment of the present invention is 1.8 mm ((0.8 mm)×2+0.2 mm). For example, it will be understood that a width of an antenna pattern is relatively increased in the antenna 102 according to the second exemplary embodiment of the present invention as compared with the antenna device 101 according to the first exemplary embodiment of the present invention, but is reduced as compared with a width of the antenna pattern of the antenna device 10 according to the related art which is "4.8 mm". When the first conductive line 1 and the second conductive line 2 partially overlap with each other, a width of an antenna pattern of the antenna device 102 according to the second exemplary embodiment of the present invention may be further reduced.

In contrast to the antenna device 101 according to the first exemplary embodiment of the present invention shown in FIG. 5A and the antenna device 102 according to the second exemplary embodiment of the present invention shown in FIG. 5B the antenna devices 103, 104, 105, 106, 107, 108, and 109 shown in FIG. 5C to 5I may further include one or more FPCB layer (e.g. 'dummy layer') having one or more conductive line (hereinafter referred to as 'dummy pattern') which are electrically separated from the conductive lines forming the loop antenna. Accordingly, the performances of the antenna devices 103, 104, 105, 106, 107, 108, and 109 shown in FIG. 5C to 5I can be improved. In more detail, if the number of loops in the loop antenna is increased, the antenna performance may be similarly increased. However, because a length of the loop antenna is fixed to a specific value corresponding to a resonance frequency (e.g., 13.56 MHz in the NFC antenna) of a frequency band to be used, the length of the conductive line may not be optionally increased. However, when a dummy pattern not electrically connected to conductive lines constituting the loop antenna is added, a resonance frequency does not vary but an induction current is generated in the dummy pattern due to an electric current flowing through a conductive line constituting the loop antenna, and a magnetic field is reinforced due to the induction current generated in the dummy pattern. Accordingly, antenna devices 103 to 109 shown in FIGS. 5A to 5I may ensure a sufficient performance of an antenna regardless of whether the length of the conductive line is increased any further.

First, in the antenna device 103 according to the third exemplary embodiment of the present invention shown in FIG. 5C, a dummy pattern 13 may be further interposed between conductive lines 11 and 12. For example, an FPCB layer including the dummy pattern 13 may be disposed between FPCB layers having the conductive lines 11 and 12. The antenna device 103 according to the third exemplary embodiment has a similar configuration to the antenna device 101 according the first exemplary embodiment except for the dummy pattern 13. Accordingly, a detailed description thereof is omitted.

The antenna device 104 according to the fourth exemplary embodiment of the present invention shown in FIG. 5D is characterized that an FPCB layer including a dummy pattern 23 is disposed at the lowest end, and FPCB layers including conductive lines 21 and 22 are laminated on an FPCB layer including the dummy pattern 23. In contrast, in the antenna device 105 according to the fifth exemplary embodiment of the present invention shown in FIG. 5E, an FPCB layer including a dummy pattern 33 is disposed at the uppermost end. For example, the antenna device 105 according to fifth exemplary embodiment is characterized that an FPCB layer including conductive lines 31 and 32 constituting a loop antenna is laminated, and an FPCB layer including the dummy pattern 33 is laminated.

Next, in contrast to the antenna devices 103, 104, and 105 according to the third to fifth exemplary embodiments, antenna devices 106, 107, 108, and 109 according to the sixth to ninth exemplary of the present invention shown in FIG. 5F to 5I are characterized such that the antenna devices 106, 107, 108, and 109 include a plurality of dummy patterns. In detail, in the antenna device 106 according to the sixth exemplary embodiment shown in FIG. 5F, dummy patterns 42 and 44 and conductive lines 41 and 43 constituting a loop antenna may be alternately arranged. In this case, the dummy patterns 42 and 44 may be disposed at top ends of the conductive lines 41 and 43 constituting a loop antenna. In addition, in the antenna device 107 according to the seventh exemplary embodiment of the present invention shown in FIG. 5G, the dummy patterns 52 and 54 are located at bottom ends of the conductive lines 51 and 53 constituting the loop antenna, respectively.

In the antenna device 108 according to the eighth exemplary embodiment of the present invention shown in FIG. 5H, dummy patterns 62 and 64 enclose conductive lines 61 and 63 constituting the loop antenna. For example, in an antenna device 108 according to the eighth exemplary embodiment of the present invention, an FPCB layer including the dummy patterns 62 and 64 may be arranged at the uppermost end and the lowermost end of the antenna device.

An antenna device 109 according to a ninth exemplary embodiment of the present invention shown in FIG. 5I is a combination of the third exemplary embodiment and the eighth exemplary embodiment of the present invention. For example, dummy patterns 72 and 76 are arranged at the uppermost end and the lowest end of the antenna device 109 so as to enclose conductive lines 71 and 73 constituting a loop antenna, and a dummy pattern 74 is further provided between the conductive lines 71 and 72.

Because antenna devices 106, 107, 108, and 109 according to the sixth exemplary embodiment to the ninth exemplary embodiment include a plurality of dummy patterns, the antenna devices 106, 107, 108, and 109 may form a strong magnetic field as compared with the third to fifth exemplary embodiments including one dummy pattern so that better performance of an antenna may be ensured.

In various embodiments, various configurations of the number, ordering and/or arrangement of layers comprising dummy patterns and conductive lines may be used. In some embodiments, a single layer may include both dummy patterns and conductive lines.

Meanwhile, antenna devices of various forms illustrated in FIGS. 5A to 5I are only an example; exemplary embodiments of the present invention are not limited thereto. For example, persons of ordinary skill in the art will appreciate that the antenna device 100 according to the present invention may be provided by a combination of various forms shown in FIGS. 5A to 5I. Although FIGS. 5C to 5I illustrate that the conductive lines and the dummy patterns have the same form, FIG. 5B illustrates that the conductive lines and dummy patterns may have different forms. For example, in an antenna device according to another exemplary embodiment of the present invention, conductive lines having different sizes are alternately arranged and dummy patterns having different sizes may be alternately arranged.

Figure 6:
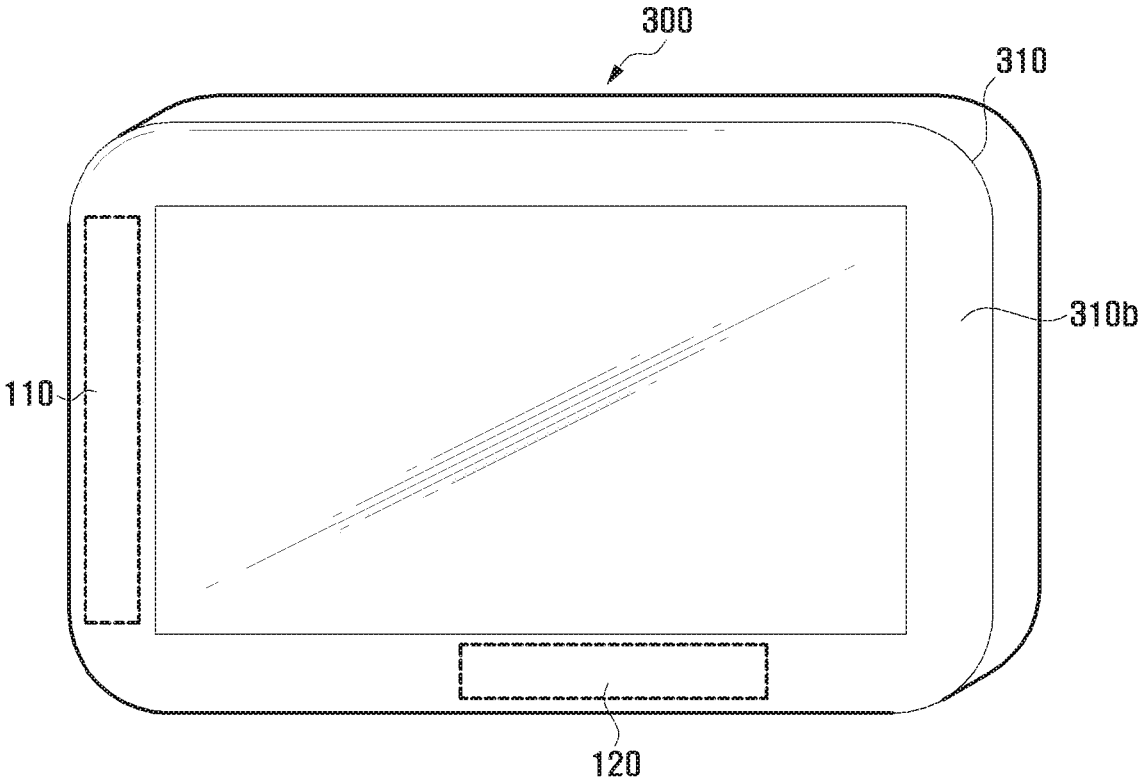
FIG. 6 is a view illustrating a portable terminal having an antenna device for near field wireless communication according to an exemplary embodiment of the present invention.

FIG. 6 is a view illustrating a portable terminal having an antenna device for near field wireless communication according to an exemplary embodiment of the present invention.

Referring to FIG. 6, a portable terminal 300 according to an exemplary embodiment of the present invention is similar to the portable terminal 200 illustrated in FIGS. 2 and 3. However, the portable terminal 300 includes a plurality of antenna devices (e.g. two antenna devices 110 and 120). The antenna devices 110 and 120 may have the same configuration as that of the foregoing antenna device 100. The antenna devices 110 and 120 may have the same configuration or may have different configurations. For example, the antenna devices 110 and 120 may be one of the antenna devices 101 to 109 according to the first to ninth exemplary embodiments illustrated in FIGS. 5A to 5I or a modified antenna device thereof. The portable terminal 300 includes a plurality of antenna devices 110 and 120 provided at a BM region 310*b* of a window 310. This is applicable to a case in which the portable terminal 300 includes a plurality of near field wireless communication modules (not shown) or the portable terminal 300 includes a near field wireless communication module which may be connected to a plurality of antenna devices.

As an example, the portable terminal 300 is applicable to a portable terminal (e.g., tablet PC) having a relatively large screen size (e.g., larger than 7 inches). This prevents reduction of convenience of use occurring when one antenna device is mounted at a side of a BM region of a portable terminal having a relatively large screen. In detail, the antenna device must be exactly located at a corresponding receiver for near field wireless communication. When the user does not exactly know a mounted location of the antenna device as the portable terminal has a size larger than that of a receiver, an antenna device mounted in the portable terminal 300 is not adjacent to the receiver so that a communication channel may not be formed. For example, the user may be inconvenienced when using a near field wireless communication function. As described above, to avoid inconveniencing the user when using a near field wireless communication function, a plurality of antenna devices are mounted in a BM region 310B of the window 310 in case of the portable terminal having a relatively large size, so that even if the user does not recognize a mounting location of the antenna device, the near field wireless communication function may be easily used.

Meanwhile, FIG. 6 illustrates that an antenna device is mounted at a left side and a bottom end of the portable terminal, but exemplary embodiments of the present invention are not limited thereto. For example, the antenna devices may be mounted in at least one of upper, lower, left, and right BM regions 310*b* of the portable terminal 300. According to exemplary embodiments of the present invention, it may be preferable for the antenna devices to be mounted at different sides of the portable terminal.

As described above, according to the antenna device for near field wireless communication and a portable terminal having the same, because the near field wireless communication antenna is mounted at a part of a BM region of the window, it is unnecessary to prepare a separate mounting space for the antenna device for near field wireless communication. According to exemplary embodiments of the present invention, convenience for a user can be improved when using a near field wireless communication function if a plurality of near field wireless communication antennas are mounted at a BM region of the window.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. An electronic device comprising:

a front surface including a window, the window including:

a transparent region, and an opaque region surrounding the transparent region;

a rear cover including a metal region; and an antenna arranged in the opaque region of the window, wherein the antenna is provided at a partial region of a lower portion of the opaque region, wherein the antenna comprises: a plurality of conductive antenna patterns of a loop type, the plurality of conductive antenna patterns including a first conductive antenna pattern disposed in a first FPCB layer and a second conductive antenna pattern being connected to the first conductive antenna pattern, the second conductive antenna pattern disposed in a second FPCB layer adjacent to the first FPCB layer, and wherein a size of loop formed by the first conductive antenna pattern is different from a size of loop formed by the second conductive antenna pattern such that an interference between the first conductive antenna pattern and the second conductive antenna pattern is reduced, and wherein a width of each of the conductive antenna patterns is smaller than a width of the opaque region such that the entirety of each of the conductive antenna patterns is within the opaque region.

2. The electronic device of claim 1, wherein the metal region is a battery cover.

3. The electronic device of claim 1, wherein the antenna further comprises:

a plurality of flexible printed circuit board (FPCB) layers stacked at a partial region of a lower portion of the opaque region, and a plurality of through holes through which adjacent conductive antenna patterns of the plurality of conductive antenna patterns are connected to each other such that the plurality of conductive antenna patterns are electrically connected to each other so as to define one loop antenna, wherein the plurality of conductive antenna patterns are provided for the plurality of FPCB layers, respectively, and wherein the plurality of conductive antenna patterns are at least partially overlapped with each other when viewed from above the partial region.

4. The electronic device of claim 3, wherein a width of each of the plurality of conductive antenna patterns is smaller than a width of the opaque region such that the entirety of each of the plurality of conductive antenna patterns is within the opaque region.

5. The electronic device of claim 3, wherein a first end of a topmost conductive antenna pattern of the plurality of conductive antenna patterns is electrically connected to a first connector through one of the plurality of through holes, wherein the first connecter is included in one of the plurality of FPCB layers, the one of the plurality of FPCB layers including a bottommost conductive antenna pattern of the plurality of conductive antenna patterns, and wherein a through hole connected to the first end of the topmost conductive antenna pattern is disposed outside the plurality of conductive antenna patterns.

6. The electronic device of claim 5, further comprising: communication circuitry, wherein the first connector and a second connector connected to a first end of the bottommost conductive antenna pattern are connected to the communication circuitry.

7. The electronic device of claim 1, wherein the antenna comprises a near field communication (NFC) antenna.

8. The electronic device of claim 1, wherein the opaque region comprises a black mask (BM) region.

9. The electronic device of claim 1, wherein the antenna is arranged in the opaque region such that signals transmitted or received by the antenna are not degraded due to the metal region of the rear cover.

10. The electronic device of claim 1, wherein the antenna further comprises: at least one dummy layer configured to reinforce a magnetic field due to an induction current.

11. The electronic device of claim 10, wherein the at least one dummy layer has the same shape as at least one conductive antenna pattern of the antenna.

12. An electronic device, comprising:

a front surface including a transparent layer, the transparent layer comprising:

a transparent region configured to transmit an image being displayed on a display, and an opaque region provided around the transparent region; a rear surface including a metal region;

communication circuitry arranged between the front surface and the rear surface; and an antenna device for near field communication (NFC), the antenna device comprising:

a stack of a plurality of flexible printed circuit board (FPCB) layers including a first FPCB layer and a second FPCB layer, a plurality of conductive antenna patterns of a loop type provided for each FPCB layer, the conductive antenna patterns being electrically connected to each other so as to define one loop antenna, and being at least partially overlapped with each other when viewed from above the opaque region, wherein the antenna device is provided at a partial region of a lower portion of the opaque region, wherein a width of each of the conductive antenna patterns is smaller than a width of the opaque region such that the entirety of each of the conductive antenna patterns is within the opaque region, wherein the plurality of conductive antenna patterns including a first conductive antenna pattern disposed in the first FPCB layer and a second conductive antenna pattern being connected to the first conductive antenna pattern, the second conductive antenna pattern disposed in the second FPCB layer adjacent to the first FPCB layer, and wherein a size of loop formed by the first conductive antenna pattern is different from a size of loop formed by the second conductive antenna pattern such that an interference between the first conductive antenna pattern and the second conductive antenna pattern is reduced, wherein a first end of a topmost conductive antenna pattern is electrically connected to a first connector through one of a plurality of through holes, the first connecter being included in one of the plurality of FPCB layers, the one of the plurality of FPCB layers including:

a bottommost conductive antenna pattern, and a through hole connected to the first end of the topmost conductive antenna pattern being disposed outside the plurality of conductive antenna patterns, and wherein the first connector and a second connector connected to a first end of the bottommost conductive antenna pattern are connected to the communication circuitry.

13. The electronic device of claim 12, wherein the metal region comprises a battery cover.

14. The electronic device of claim 12, wherein the opaque region comprises a black mask (BM) region.

15. The electronic device of claim 12, wherein the antenna device is arranged in the opaque region such that signals transmitted or received by the antenna device are not degraded due to the metal region of the rear cover.

16. The electronic device of claim 12, wherein the antenna device further comprises: at least one dummy layer configured to reinforce a magnetic field due to an induction current.

17. The electronic device of claim 16, wherein the at least one dummy layer has the same shape as at least one of the conductive antenna patterns.

* * * * *